US008758062B2

(12) United States Patent
Hung et al.

(10) Patent No.: US 8,758,062 B2
(45) Date of Patent: Jun. 24, 2014

(54) CABLE CONNECTOR WITH IMPROVED INSULATIVE HOUSING

(75) Inventors: Yung-Chih Hung, Jhonghe (TW); Wang-I Yu, Jhonghe (TW); Hung-Chi Tai, Jhonghe (TW)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 22 days.

(21) Appl. No.: 13/547,931

(22) Filed: Jul. 12, 2012

(65) Prior Publication Data

US 2013/0323983 A1 Dec. 5, 2013

(30) Foreign Application Priority Data

Jun. 1, 2012 (CN) ..... 2012 1 0177746

(51) Int. Cl.
*H01R 24/00* (2011.01)

(52) U.S. Cl.
USPC ..... 439/660

(58) Field of Classification Search
USPC ..... 439/660, 552, 465, 682, 719, 460, 701, 439/752, 595
See application file for complete search history.

(56) References Cited

U.S. PATENT DOCUMENTS

| | | | | | |
|---|---|---|---|---|---|
| 5,108,310 | A | * | 4/1992 | Sawada et al. | 439/595 |
| 5,116,236 | A | * | 5/1992 | Colleran et al. | 439/271 |
| 5,224,883 | A | * | 7/1993 | Yamamoto | 439/752 |
| 5,267,874 | A | * | 12/1993 | Koegel et al. | 439/497 |
| 5,281,168 | A | * | 1/1994 | Krehbiel et al. | 439/595 |
| 5,288,250 | A | * | 2/1994 | Sumida | 439/701 |
| 5,520,550 | A | * | 5/1996 | Okabe | 439/404 |
| 5,595,509 | A | * | 1/1997 | Fry et al. | 439/752 |
| 5,653,613 | A | * | 8/1997 | Shimoda | 439/752 |
| RE35,820 | E | * | 6/1998 | Guginsky | 174/102 R |
| 5,944,552 | A | * | 8/1999 | Hanami | 439/465 |
| 5,953,815 | A | * | 9/1999 | Kaminski et al. | 29/860 |
| 5,967,859 | A | * | 10/1999 | Cecil et al. | 439/752 |
| 6,039,611 | A | * | 3/2000 | Yang | 439/701 |
| 6,068,522 | A | * | 5/2000 | Aoyama et al. | 439/701 |
| 6,106,326 | A | * | 8/2000 | Schramme | 439/460 |
| 6,293,829 | B1 | * | 9/2001 | Qiao et al. | 439/719 |
| 6,398,585 | B1 | * | 6/2002 | Fukuda | 439/587 |
| 6,506,081 | B2 | * | 1/2003 | Blanchfield et al. | 439/682 |
| 7,059,892 | B1 | * | 6/2006 | Trout | 439/465 |
| 7,137,848 | B1 | * | 11/2006 | Trout et al. | 439/465 |
| 7,301,100 | B2 | * | 11/2007 | Drane et al. | 174/67 |
| RE41,283 | E | * | 4/2010 | Evans et al. | 439/680 |
| 7,959,361 | B2 | * | 6/2011 | Lu et al. | 385/53 |
| 8,323,049 | B2 | * | 12/2012 | Ngo | 439/552 |
| 2003/0081905 | A1 | * | 5/2003 | Bethea et al. | 385/55 |
| 2006/0231282 | A1 | * | 10/2006 | Greenfield | 174/67 |
| 2009/0286411 | A1 | * | 11/2009 | Bazayev et al. | 439/145 |
| 2011/0104919 | A1 | * | 5/2011 | Patel et al. | 439/137 |
| 2011/0223785 | A1 | * | 9/2011 | Jiang et al. | 439/106 |
| 2011/0284216 | A1 | * | 11/2011 | Addis et al. | 166/250.01 |
| 2012/0002356 | A1 | * | 1/2012 | Linnane et al. | 361/679.01 |

* cited by examiner

*Primary Examiner* — Alexander Gilman
(74) *Attorney, Agent, or Firm* — Sughrue Mion, PLLC

(57) ABSTRACT

A cable connector in accordance with the present invention includes an insulative housing and a number of conductive contacts received in the insulative housing. The insulative housing includes a main portion and a mating portion extending forwardly from the main portion. The insulative housing defines a number of leading recesses with H-shape cross section defined in the main portion. The conductive contacts are divided into a first group of contacts and a second group of contacts. Each of the first group of contacts includes a first cable termination portion. Each of the second group of contacts includes a second cable termination portion. The first and second cable termination portions are received in corresponding leading recesses with H-shape cross section.

10 Claims, 5 Drawing Sheets

CABLE CONNECTOR WITH IMPROVED INSULATIVE HOUSING

BACKGROUND OF THE INVENTION

1. Field of the Invention

The present invention relates to an electrical connector, more particularly to a cable connector electrically connecting with a cable.

2. Description of Related Art

A conventional cable connector usually comprises an insulative housing and a plurality of conductive contacts accommodated in the insulative housing. Since the length of the conductive contact of the above conventional cable connector is relatively long, the length of the contact-receiving slot in the insulative housing for receiving the conductive contact is also relatively long and has high requirement to the contact-receiving slot. Hence, the insulative housing will swing or shake when electrically connecting with a complementary connector because of the relatively long length thereof, and the structure stability of the insulative housing is weak which influences the electrical connection effect between the cable connector and the complementary connector consequently.

Hence, it is necessary to improve the conventional cable connector to address problems mentioned above.

BRIEF SUMMARY OF THE INVENTION

Accordingly, an object of the present invention is to provide a cable connector which is of simple structure, and of high structure stability.

In order to achieve the above-mentioned object, a cable connector in accordance with the present invention comprises an insulative housing and a plurality of conductive contacts received in the insulative housing. The insulative housing comprises a main portion and a mating portion extending forwardly from the main portion. The insulative housing defines a plurality of leading recesses with H-shape cross section defined in the main portion. The conductive contacts are divided into a first group of contacts and a second group of contacts. Each of the first group of contacts comprises a first cable termination portion. Each of the second group of contacts comprises a second cable termination portion. The first and second cable termination portions are received in corresponding leading recesses with H-shape cross section.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
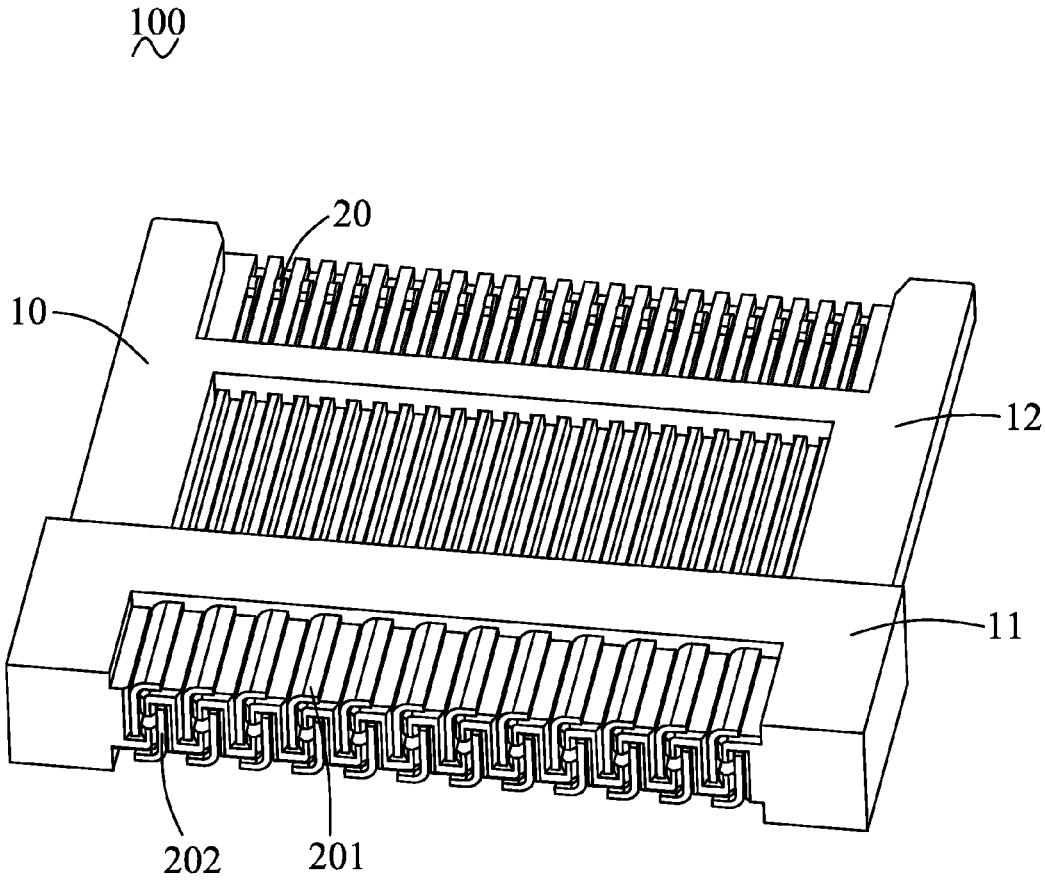
FIG. 1 is an assembled, perspective view of a cable connector in accordance with the present invention.

In the following description, numerous specific details are set forth to provide a thorough understanding of the present invention. However, it will be obvious to those skilled in the art that the present invention may he practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
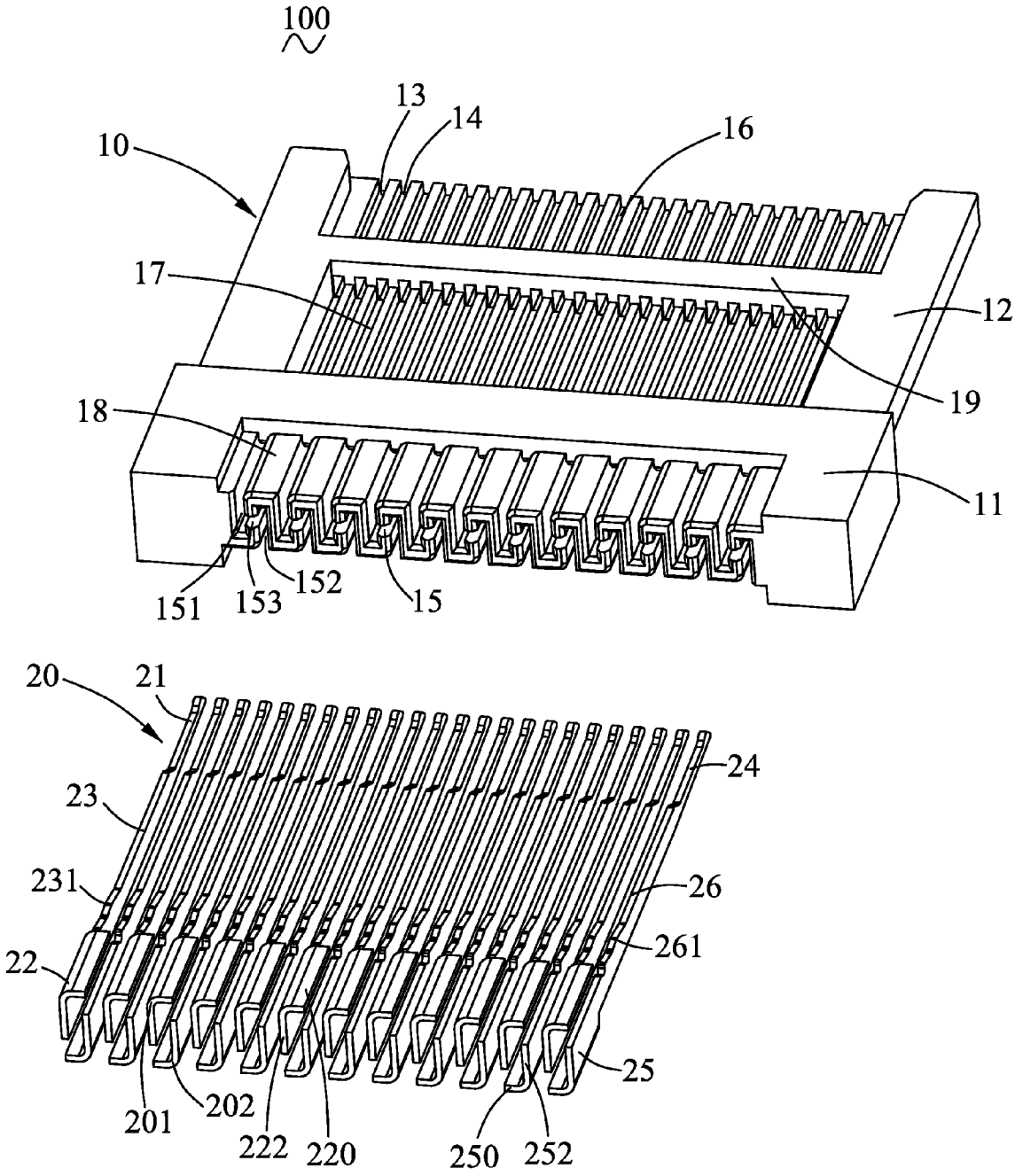
FIG. 2 is an exploded, perspective view of the cable connector of FIG. 1.

Please refer to FIGS. 1-2, a cable connector 100 in accordance with the present invention comprises an insulative housing 10, and a plurality of conductive contacts 20 retained in the insulative housing 10. The conductive contacts 20 comprise a first group of contacts 201 and a second group of contacts 202 alternatively disposed with the first group of contacts 201.

Please refer to FIGS. 1-4, the insulative housing 10 comprises a main portion 11 and a mating portion 12 extending forwardly from the main portion 11. On one side of the mating portion 12, a plurality of first receiving slots 13 for receiving the first group of contacts 201 and a plurality of second receiving slots 14 for receiving the second group of contacts 202 are defined. The first receiving slots 13 and the second receiving slots 14 are alternatively arranged, and both of them extend from the rear end of the main portion 11 to the mating portion 12 along the insertion direction of the first group of contacts 201 and the second group of contacts 202.

The main portion 11 of the insulative housing 10 defines a plurality of leading recesses 15 with H-shape cross-section penetrating through the main portion 11. The leading recess 15 comprises a first side recess 151, a second side recess 152 parallel to the first side recess 151, and a central recess 153 transversely connecting the first side recess 151 and the second side recess 152 to form the H-shape cross section of the leading recess 15. The first receiving slot 13 communicates with the first side recess 151, while the second receiving slot 14 communicates with the second side recess 152.

Figure 5:
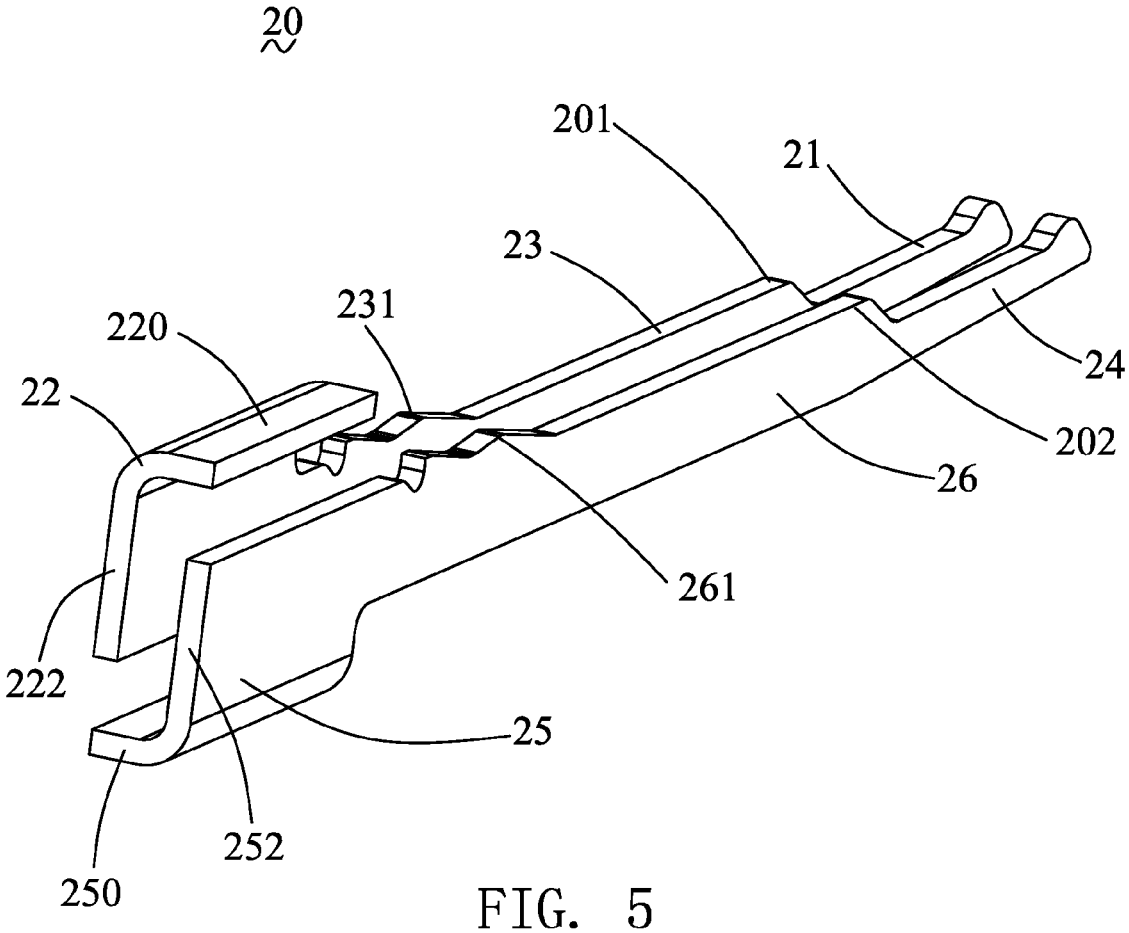
FIG. 5 is a perspective view of conductive contacts of the cable connector shown in FIG. 2.

Please refer to FIG. 5 in combination with FIG. 2, each of the first group of contacts 201 comprises a first cable termination portion 22, a first contacting portion 21, and a first connecting portion 23 connecting the first contacting portion 21 with the first cable termination portion 22. Each of the second group of contacts 202 comprises a second cable termination portion 25, a second contacting portion 24 and a second connecting portion 26 connecting the second contacting portion 24 with the second cable termination portion 25. In the preferred embodiment of the present invention, the first cable termination portion 22 and the second cable termination portion 25 are both of L-shape and disposed in pairs to form a frame shape therebetween. That means the first cable termination portion 22 and the second cable termination portion 25 are arranged in reversed directions and face to each other to form the frame shape. The L-shape first cable termination portion 22 comprises a first horizontal section 220 and a first vertical section 222 extending downwardly from one end of the first horizontal section 220. The L-shape second cable termination portion 25 comprises a second horizontal section 250 and a second vertical section 252 extending upwardly from one end of the second horizontal section 250. Thus, in the pair of the first and second cable termination portions 22, 25, the first and second horizontal sections 220, 250 are parallel to each other, and the first and second vertical sections 222, 252 are parallel to each other to form the frame described above.

Figure 3:
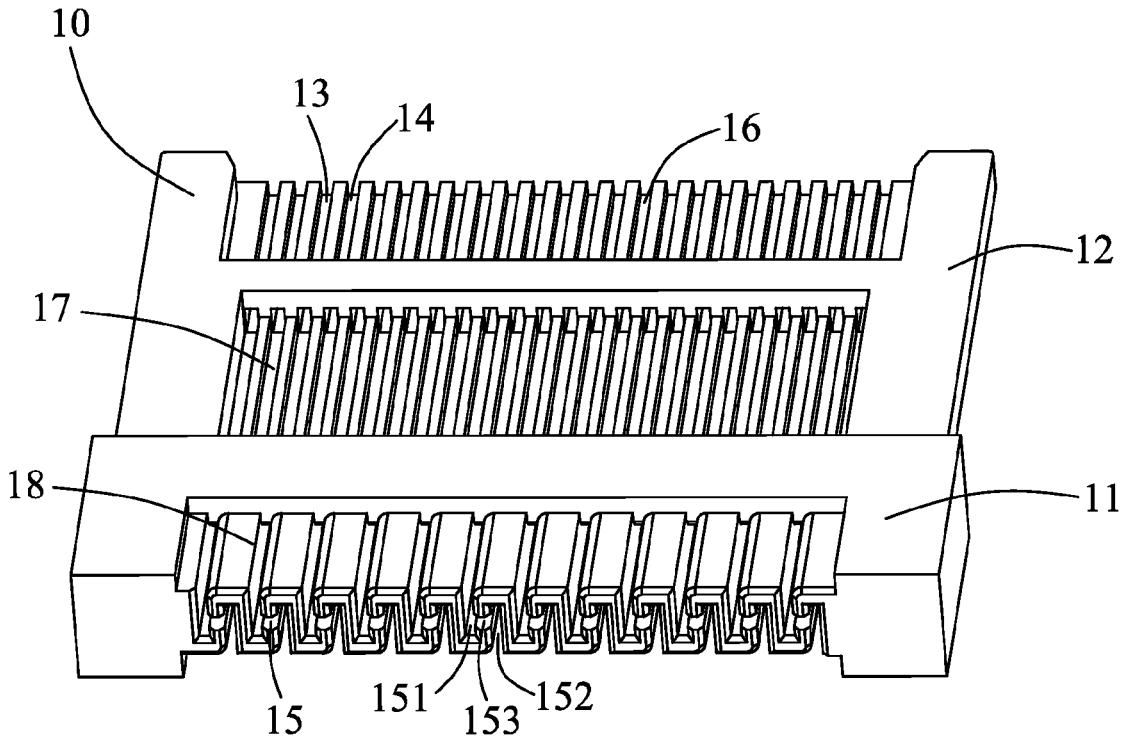
FIG. 3 is a perspective view of an insulative housing of the cable connector shown in FIG. 2.
Figure 4:
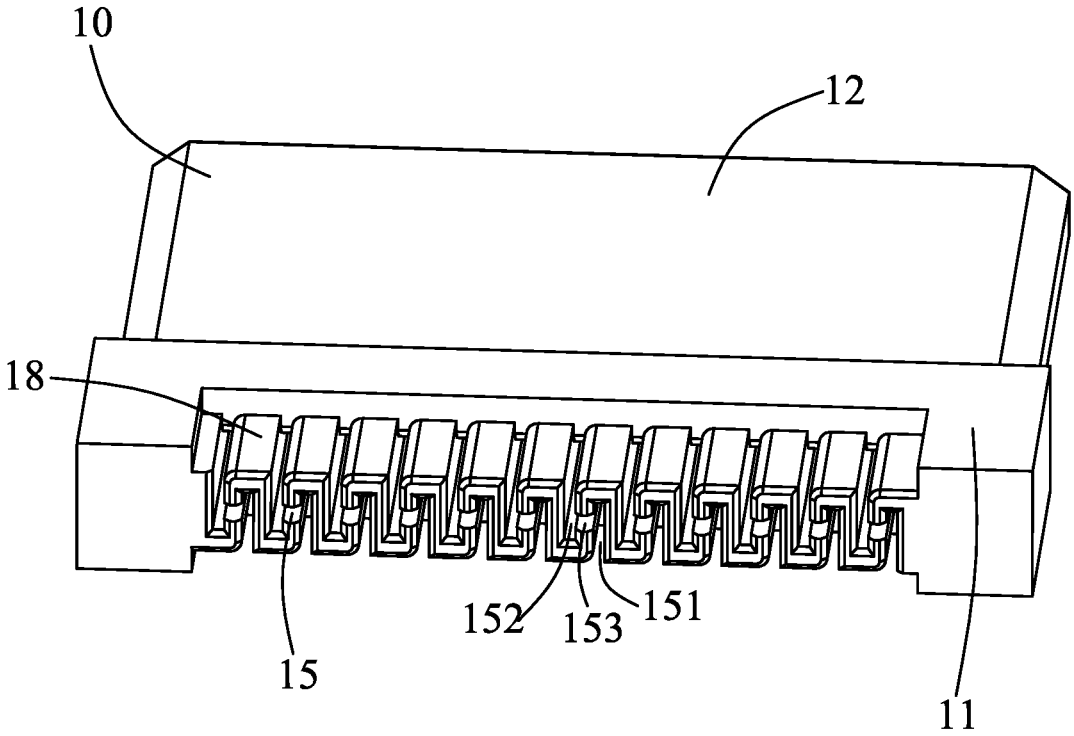
FIG. 4 is a view similar to FIG. 3, but from a different view.

Please refer to FIG. 3 in combination with FIG. 5, the insulative housing 10 also can he divided into three regions: a front receiving region 16 for receiving the first contacting portions 21 and the second contacting portions 24, a middle guiding region 17 for guiding and receiving the first connecting portions 23 and the second connecting portions 26, and a rear receiving region 18 for receiving the first cable termination portions 22 and the second cable termination portions 25.

In the preferred embodiment of the present invention, the front receiving region 16 is recessed downwardly from a top surface of the mating portion 12, and the first contacting portions 21 and the second contacting portions 24 are located on the same side of the front receiving region 16 and exposed to the outside partially. The middle guiding region 17 is also recessed downwardly from the top surface of the mating portion 12 and separated from the front receiving region 16 by a transverse bar 19, and the first connecting portions 23 and the second connecting portions 26 are located at the same side of the middle guiding region 17 and exposed to the outside partially. The rear receiving region 18 is recessed downwardly and upwardly from opposite top and bottom surfaces of the rear receiving region 18. The first side recess 151 opens toward the top surface of the rear receiving region 18, and the second side recess 152 opens toward the bottom surface of the rear receiving region 18. The first cable termination portions 22 are respectively received in the first side recesses 151, while the second cable termination portions 25 are respectively received in the second side recesses 152, and both are partially exposed to the outside, that is the first and second horizontal sections 220, 250 are exposed to the outside.

The first connecting portion 23 and the second connecting portion 26 are of flat sheet. A plurality of first barbs 231 and a plurality of second barbs 261 are formed on an upper side edge of the first and second connecting portions 23, 26 and interfere with the middle guiding region 17 to restrict the first group of contacts 201 and the second group of contacts 202 in the insulative housing 10 reliably, hence enhancing the electrical connection effect between the cable connector 100 and the complementary connector.

In summary, the cable connector 100 in accordance with the present invention, via the leading recesses 15 with H-shape cross section defined in the main portion 11 of the insulative housing 10, realizes retaining the conductive contacts 20 reliably in the insulative housing 10 to improve the structure stability and simple structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A cable connector, comprising:

an insulative housing comprising a main portion and a mating portion extending forwardly from the main portion, the insulative housing defining a plurality of leading recesses with H-shape cross section defined in the main portion;

a plurality of conductive contacts received in the insulative housing and divided into a first group of contacts and a second group of contacts, each of the first group of contacts comprising a first cable termination portion, each of the second group of contacts comprising a second cable termination portion, the first and second cable termination portions received in corresponding leading recesses with H-shape cross section;

wherein each first cable termination portion is of L-shape, and each second cable termination portion is of L-shape and arranged in a reversed direction relative to the first cable termination portion to form a frame shape therebetween, wherein the first and second cable termination portions are in pair to be received in the same corresponding leading recess.

2. The cable connector as claimed in claim 1, wherein each first cable termination portion comprises a first horizontal section, and a first vertical section extending downwardly from the first horizontal section, and each second cable termination portion comprises a second horizontal section and a second vertical section extending upwardly from the second horizontal section, and wherein in a pair of first and second cable termination portions, the first and second horizontal sections are parallel to each other and the first and second vertical sections are parallel to each other to form the frame shape.

3. The cable connector as claimed in claim 1, wherein each leading recess comprises a first side recess to receive the L-shape first cable termination portion, a second side recess to receive the L-shape second cable termination portion and a central recess communicating with the first and second side recesses to form the H-shape cross section.

4. The cable connector as claimed in claim 3, wherein the mating portion of the insulative housing defines a plurality of first receiving slots for the first group of contacts, and a plurality of second receiving slots for the second group of contacts arranged alternatively with the first receiving slots, wherein each first receiving slot communicates with the first side recess, and each second receiving slot communicates with the second side recess.

5. The cable connector as claimed in claim 4, wherein each of the first group of contacts further comprises a first contacting portion received in the first receiving slot, and a first connecting portion connecting the first contacting portion and the first cable termination portion and received in the first receiving slot, each of the second group of contacts further comprises a second contacting portion received in the second receiving slot, and a second connecting portion connecting the second contacting portion and the second cable termination portion and received in the second receiving slot.

6. The cable connector as claimed in claim 1, wherein each of the first group of contacts further comprises a first contacting portion, and a first connecting portion connecting the first contacting portion and the first cable termination portion, each of the second group of contacts further comprises a second contacting portion, and a second connecting portion connecting the second contacting portion and the second cable termination portion.

7. The cable connector as claimed in claim 6, wherein the insulative housing is divided into a front receiving region to receive the first and second contacting portions of the first and second groups of contacts, a middle guiding region to receive the first and second connecting portions, and a rear receiving portions to receive the first and second cable termination portions.

8. The cable connector as claimed in claim 7, wherein the front receiving region is recessed downwardly from a top surface of the mating portion of the insulative housing, and wherein the first and second contacting portions of the first and second groups of contacts are located on the same side of the front receiving region and exposed to the outside partially.

9. The cable connector as claimed in claim 7, wherein the middle guiding region is recessed downwardly from a top surface of the mating portion of the insulative housing, and wherein the first and second connecting portions of the first and second groups of contacts are located on the same side of the middle guiding region and exposed to the outside partially.

10. The cable connector as claimed in claim 7, wherein the rear receiving region is recessed upwardly and downwardly from opposite top and bottom surfaces of the main portion, and the first side recess opens toward the top surface of the rear receiving region, and the second side recess opens toward the bottom surface of the rear receiving region, and the first and second cable termination portions are received in the rear receiving region and partially exposed to the outside.

* * * * *